United States Patent [19]

Blatt

[11] Patent Number: 4,572,414

[45] Date of Patent: Feb. 25, 1986

[54] SMOKE EJECTOR CARRIER

[75] Inventor: Howell L. Blatt, Richboro, Pa.

[73] Assignee: Ziamatic Corporation, Yardley, Pa.

[21] Appl. No.: 689,416

[22] Filed: Jan. 7, 1985

[51] Int. Cl.[4] ..... A45F 3/08

[52] U.S. Cl. ..... 224/212; 224/210; 224/262; 224/907

[58] Field of Search ..... 98/88.1, 29; D3/32; D23/163, 164; 224/202, 209, 210, 270, 268, 261, 262, 263, 153, 907, 211, 212, 214, 215

[56] References Cited

U.S. PATENT DOCUMENTS

| | | | |
|---|---|---|---|
| D. 199,296 | 9/1964 | Kallman | D3/32 X |
| 2,013,950 | 9/1935 | Davidson . | |
| 2,079,170 | 5/1937 | Horsley . | |
| 2,266,294 | 12/1941 | Allderdice . | |
| 2,450,722 | 10/1948 | Drije . | |
| 2,606,701 | 8/1952 | Huthsing . | |
| 2,606,732 | 8/1952 | Luomala . | |
| 2,712,404 | 7/1955 | Miller | 224/270 X |
| 2,717,109 | 9/1955 | Walsh . | |
| 2,728,519 | 12/1955 | McLarty | D23/164 X |
| 2,841,317 | 7/1958 | Elden | 224/907 X |
| 3,127,077 | 3/1964 | Faro | 224/214 X |
| 3,155,358 | 11/1964 | Carlson . | |
| 3,219,243 | 11/1965 | Mack | 224/263 X |
| 3,246,644 | 4/1966 | Peterson . | |
| 3,508,691 | 4/1970 | Langbehn . | |
| 3,938,718 | 2/1976 | Madison | 224/262 |
| 4,145,028 | 3/1979 | Kelley et al. | 224/263 X |
| 4,325,503 | 4/1982 | Swinney . | |
| 4,398,690 | 8/1983 | Rutledge . | |

*Primary Examiner*—Stephen Marcus
*Assistant Examiner*—Robert Petrik
*Attorney, Agent, or Firm*—Sperry, Zoda & Kane

[57] ABSTRACT

A carrier of the backpack type is disclosed, for use by firefighters in transporting a smoke ejector to a location within the building where it is to be used in removing smoke from the building interior. A back plate may be quickly strapped to the firefighter's back, and includes a first pair of clamp elements affixed to the back plate. Second and third pairs of movable clamp elements are carried by a pair of transversely spaced bars mounted on the back plate for slidable and rotatable movement. The second and third pairs are spaced longitudinally of the bars, so that either movable pair of clamp elements can be used in cooperation with the fixed clamps, to engage the frame of a smoke ejector. The bars are under spring bias tending to urge the selected pair of movable clamp elements toward the fixed pair, for quickly and securely gripping the smoke ejector frame.

12 Claims, 3 Drawing Figures

SMOKE EJECTOR CARRIER

BACKGROUND OF THE INVENTION

1. Field of the Invention

The present invention relates generally to special purpose carriers, and in a more particular sense, to carriers of the backpack type, adapted to be strapped to the back of a user, and so designed as to permit quick engagement or release of an exteriorly framed object having upper and lower cross members as components of its external frame. In particular, the object to be carried would be a smoke ejector. Typically, a smoke ejector used by firefighters is in the form of a rectangular frame, enclosing a cylindrical blower, so designed that the frame can be suspended within a doorway, window opening, or at any other selected location, for the purpose of exhausting smoke from the interior of a building.

2. Description of the Prior Art

Considerable difficulty is experienced by firefighters in carrying smoke ejectors into a building, to a location at which the smoke ejector is to be used. Smoke ejectors are large, heavy, cumbersome objects. Heretofore, the practice has been for the firefighter to carry the smoke ejector in his hands, or alternatively, it has been necessary for two firefighters to carry the smoke ejector between them. Or, it may be necessary to haul the smoke ejector up to a window on a rope. Any of these procedures is clearly undesirable. They obviously require a great amount of care, to assure that the smoke ejector is not accidentally dropped with probable damage to the smoke ejector as well as potential injury to the firefighter. Further, excessive time may and usually will be required in transporting the smoke ejector in this way. Perhaps even more importantly, carrying the smoke ejector in the manner hereinabove indicated has the obvious disadvantage that the firefighters are prevented from having their hands free to move equipment, carry firefighting tools, or permit the firefighter to climb ladders.

The prior art has not, so far as is known, heretofore proposed a carrier designed for the specific purpose of carrying a smoke ejector. The primary object of the present invention is to provide such a device. In this way, it is proposed to overcome the problems discussed previously herein.

It is further proposed in overcoming the problems noted above, to at the same time permit the entire device to be quickly strapped to or disconnected from the wearer's body. It is basic, in fighting fires, that every second counts, so that it becomes important that any equipment used at the scene of a fire be designed to save all the time possible, to assure that the firefighter will perform all of his or her tasks with maximum speed and efficiency. To this end, and further in an effort to overcome the problems noted above, the device is designed to permit a smoke ejector to be clamped thereto with maximum speed and facility, responsive merely to grasping of a pair of handles, pulling them upwardly to locate movable clamps in proper position, and releasing the handles so that the smoke ejector will be instantly and securely clamped to the carrier, ready for transport to the location at which it is to be used in exhausting smoke from the building.

SUMMARY OF THE INVENTION

Summarized briefly, the present invention includes a flat, light but strong back plate, provided with straps to facilitate its being quickly strapped to the wearer's back. On the back plate, a first pair of clamps is fixedly mounted. These are adapted to receive the lower, front cross member of a smoke ejector frame, merely responsive to dropping of the frame onto the lower clamps.

Transversely spaced, parallel support bars are mounted on the back plate above the lower clamps, for slidable and rotatable movement. Springs are interposed between the back plate and the bars, tending to bias them slidably toward the lower clamps. At the upper ends of the bars two pairs of movable, upper clamps are provided. One of these pairs is used for clamping the upper cross member of smaller smoke ejectors, while the other pair of clamps carried by the bars is used for larger smoke ejectors. One set of clamps carried by the bar is angularly spaced about the bar 90° from the other. As a result, the bar can be rotated through 90°, in such a way as to position one set of the clamps carried thereby operatively, while automatically retracting the other set to an out of the way position. Conversely, rotation of the bar in the opposite direction causes the other set to be extended rearwardly for grasping the smoke ejector cross member, while at the same time locating the other set of clamps carried by the bars in an out of the way, retracted position in respect to the smoke ejector. Indexing of the bar between its opposite extreme positions is effected by providing perpendicularly related surfaces on one of the sets of clamps carried by it, these surfaces being adapted for engaging the back plate in the opposite extreme positions to which the bars are turned.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
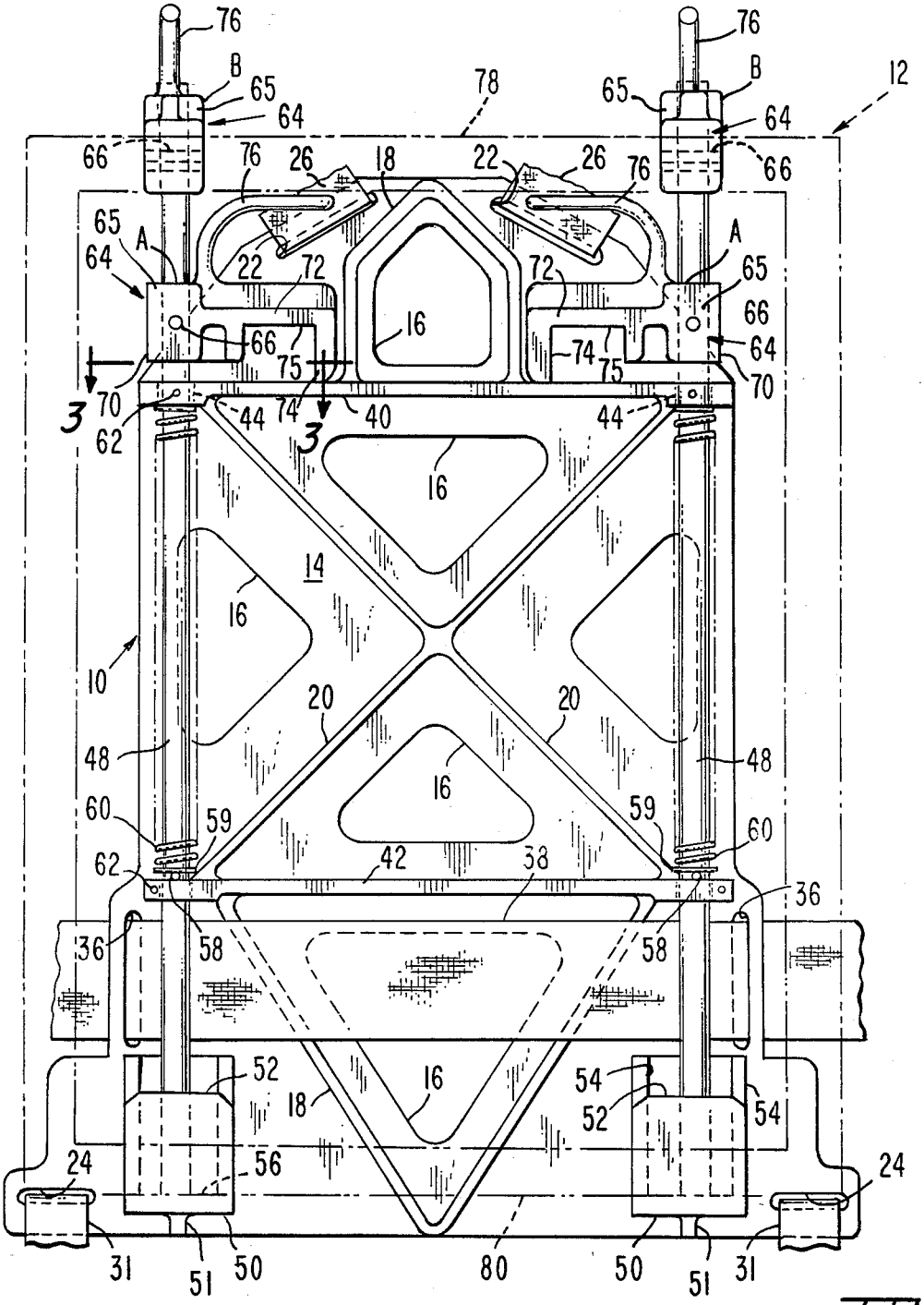
FIG. 1 is a front elevational view of the carrier comprising the present invention, a smoke ejector frame being illustrated in dotted lines as it appears when clampably supported by the carrier, portions of the straps being broken away.

The carrier comprising the present invention has been generally designated 10, and is illustrated in supporting relationship to a conventional smoke ejector 12. The smoke ejector has been illustrated in dotted lines, and only so much of the smoke ejector as is needed for an understanding of the present invention, is illustrated.

The carrier 10 includes a flat, wide back plate 14, which may be made from any suitably strong material, and which in the present instance is of metal, having a series of weight reduction openings 16, and strengthening ribs 18 extending about said openings. In addition, a pair of crossing ribs 20 further strengthen the back plate in relation to its relatively light weight.

The back plate can be of cast metal, so that the several ribs are integral therewith, and along with the openings are formed during the casting of the one-piece plate.

Figure 2:
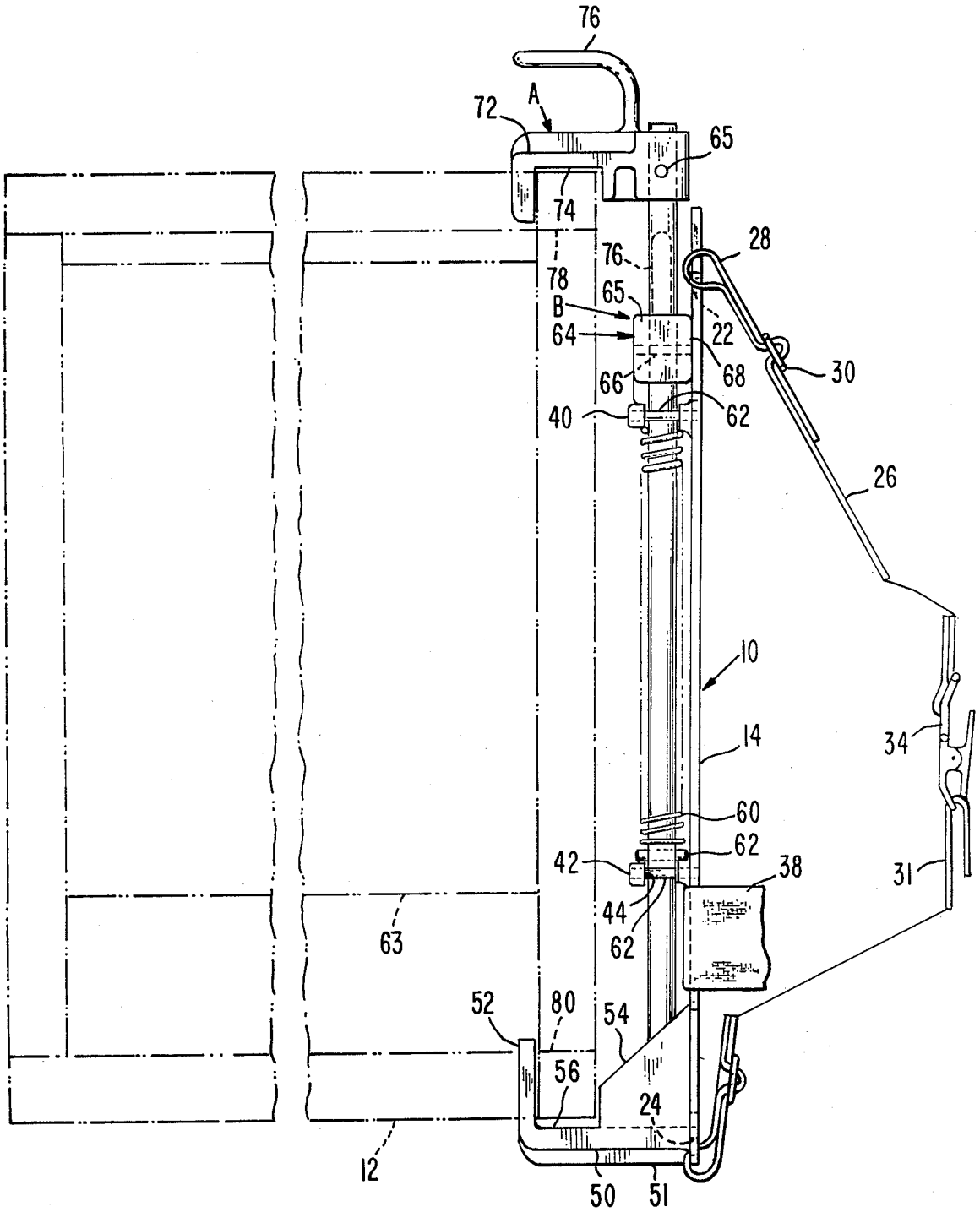
FIG. 2 is a side elevational view of the carrier as it appears when seen from the right of FIG. 1, the smoke ejector frame being illustrated in dotted lines, the carrying straps being shown fragmentarily.

Also formed in the back plate, at the upper end thereof, are upper shoulder strap slots 22, and lower shoulder strap slots 24. Referring to FIG. 2, the upper slots 22 permit connection of upper shoulder straps 26 to the upper end of the back plate, adjacent the respective sides of the back plate, said shoulder straps having loops 28 formed by adjustable buckles 30. Similarly, lower straps 31 have loops formed by adjustable buckles 32 and passing through the lower slots 24.

There is thus a pair of shoulder straps at one side defined by a strap 26 and strap 31, and a similar shoulder strap at the other side defined by the other strap 26 and its associated strap 31. At each side of the wearer's body, the associated straps 26, 31 are quickly connected or disconnected by means of a buckle 34.

In use, the buckle 34 may be left connected, so that the wearer may simply put his arms through the respective connected straps, and thereafter tighten the straps by means of the buckle 34.

Also provided is a waist strap. A short distance upwardly from the lower end of the back plate, there are provided at opposite sides thereof vertically extending waist strap slots 36, receiving a waist strap 38, the opposite ends of which are brought about the waist of the wearer and buckled in front of the wearer's body.

In this way, the back plate can be swiftly strapped to the wearer's back, and can with equal swiftness be removed after the smoke ejector 12 has been carried to the location at which it is to be placed in use.

Figure 3:
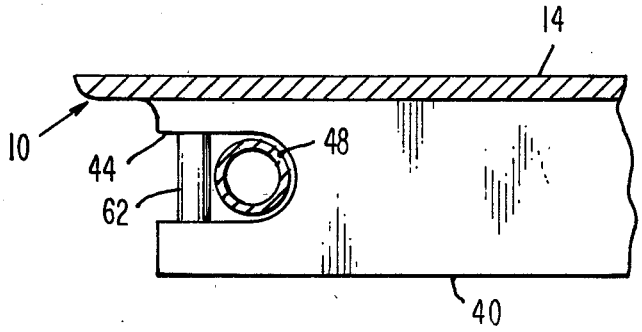
FIG. 3 is a detail sectional view substantially on line 3—3 of FIG. 1.

Also cast integrally with the back plate are horizontal, vertically spaced, parallel, transversely extending guide ribs 40, 42 respectively, each of which has recesses 44 formed in its opposite ends, said recesses opening laterally outwardly (see FIG. 3).

The guide ribs 40, 42 serve as means for guiding a pair of vertically disposed, parallel, clamp support bars 48. Bars 48, at their lower ends, normally seat against lower clamp elements 50. A pair of the elements 50 is provided, as seen from FIG. 1, said elements being identically formed, and being spaced transversely of the back plate, to which they are integrally or otherwise fixedly secured. Clamp elements 50 (see also FIG. 2) are strengthened or rigidified by strengthening ribs 51 integral therewith and rigid with the back plate. The lower, fixed clamp elements 50 project rearwardly from the back plate, and at their free ends have upwardly projecting retaining flanges 52, cooperating with side flanges 54 in defining an upwardly opening recess or seat 56 for the lower portion of the smoke ejector frame.

Referring to FIG. 1, the bars 48 are under spring bias tending to urge the same downwardly toward the clamp elements 50. To this end, there is provided in each bar a cross pin 58, above which is disposed a washer 59 against which there is seated the lower end of a compression coil spring 60, the upper end of which bears against the underside of the rib 40 of the back plate.

Bars 48 are mounted for axial sliding movement and for rotation upon the back plate. To this end, the bars, with the springs 60 mounted thereon, are mounted upon the back plate by inserting the bars laterally inwardly into the slots or recesses 44 formed in the ends of the transverse ribs 40, 42. Thereafter, the bars are retained by pins 62, closing the ends of the recesses 44. See FIG. 3.

At this point, it may be noted that the smoke ejector 12 includes an external frame, in which is mounted a cylindrical blower 63.

The frame of the ejector is in the form of an open, rectangular framework protectively shielding the cylindrical blower 63. The front end of the framework is adapted to seat in the upwardly opening recesses 56 of the stationary first pair of clamp elements 50. The upper portion of the front end of the smoke ejector frame engages in downwardly opening recesses provided in either a first pair of movable clamp elements A, or a second set B, according to the size of the particular smoke ejector that is to be transported.

The clamp elements A and B are individually all formed identically so as to simplify manufacture of the device. Accordingly, the description of one such clamp element will suffice for all.

The movable clamp elements have been designated generally at 64, and each includes a mounting block or sleeve 65, having an end-to-end bore through which bar 48 extends. The block or sleeve 65, after being properly positioned upon the bar, is pinned thereto as at 66 so as to become fixedly attached to the bar for slidable and rotatable movement therewith.

Externally, each block 65 has perpendicularly related, flat indexing surfaces 68, 70. The lower set A of movable clamp elements 64 is so located upon the associated bars 48, that when the bars 48 are spring urged downwardly to their maximum extent shown in FIGS. 1 and 2, one or the other of the flat surfaces 68, 70 will be in face-to-face contact with the surface of back plate 14. Thus, as shown in FIG. 1, and also in FIG. 2, when the clamp elements 64 of set or pair A are to be disposed inoperatively, they are positioned as shown in the drawings, with elongated arms 72 thereof extending laterally inwardly in a retracted, out-of-the-way position against the back plate.

In this position of the clamp elements of set A, the elements of this set are incapable of gripping the framework of the smoke ejector, and indeed, will be wholly out of contact with the smoke ejector, as shown in FIG. 2 to best advantage.

Further considering the specific construction of each clamp element, as above noted, each element includes elongated arms 72. These arms, which can properly be considered as clamping arms, are integral with their associated mounting blocks or sleeves 65. Each arm 72, as noted in FIG. 1, includes a depending flange 74 at its distal end, defining a clamping recess 75 that opens downwardly so as to be adapted to engage the upper portion of the smoke ejector frame, when the clamping elements are operatively positioned.

Also integral with each clamping arm 72 and its associated mounting block or sleeve 65 is an upwardly and laterally curving handle 76. This may be grasped by a user for conveniently pulling the associated bar 48 upwardly against the restraint of the string 60 through which the bar extends.

It should be observed at this point that the clamp elements of the lower set A, and the clamp elements of the upper set or pair B, are individually all identical to one another, thus simplifying design and manufacturing costs generally. Of importance, however, is the fact that as shown in FIGS. 1 and 2, the clamping elements of the upper set B are pinned to their associated bars 48 at an angular distance, taken circumferentially of the bars, of 90° from the clamping elements of the lower set. As a result, in the position of the bars shown in FIGS. 1 and 2, the elements of pair A have their arms 72 extending laterally inwardly toward each other flat against the back plate in retracted, out-of-the-way positions with respect to the smoke ejector flame, thus disposing the elements of pair A inoperatively.

Whenever the elements of pair A are so disposed in retracted, out-of-the-way positions, the clamping elements of pair B are, conversely, projected rearwardly in operative positions, in which their downwardly opening recesses 75 will receive and clampably engage the upper cross member 78 of the smoke ejector frame. In this position of the parts, the recesses 74 (see FIG. 2) are in vertically aligned, confronting relation to the upwardly opening recesses 56 of the stationary first pair of clamp elements 50.

The purpose of having one pair A of movable clamp elements 64 spaced longitudinally of the bars 48 from another set B of said movable clamp elements, is to permit the carrier to accommodate smoke ejectors of different sizes. A smaller smoke ejector would have a vertical dimension which is less than the vertical dimension of the smoke ejector pictured. Accordingly, a smaller smoke ejector would be more efficiently gripped by the lower pair of movable clamp elements designated A, rather than the upper pair B of said clamp elements.

It will be seen that when the carrier is not in use, it is highly desirable that the bars 48 be properly positioned with the bars 48 engaged against accidental rotation. Such freedom of rotation might have the several clamp elements of the bars swinging loosely to various positions in respect to one another, when the carrier is not in use. This is not only untidy in respect to facilitating storage of the carrier on the firetruck or other equipment, but also, valuable time can be lost by the firefighter in realigning a selected pair of the movable clamp elements, during the actual engagement of a smoke ejector by the carrier.

Accordingly, when the flat surfaces 68 are positioned in contact with the back plate, the pair A is inoperatively disposed as shown, with their arms 72 extending laterally inwardly as described above, in out-of-the-way positions. This positioning of the clamp elements A automatically causes the clamp elements of pair B to be operatively disposed. The surfaces 68, 70, thus index the bar between the opposite extremes of its 90° angular travel, with the pair A being inoperatively disposed and pair B operatively disposed at one of said extremes, and with the pairs A, B, reversing their operative and inoperative relationships when the bar is rotated through 90° to dispose indexing services 70 against the back plate rather than the surfaces 68.

In use, and assuming that a larger smoke ejector is to be transported, one pulls upon the handle 76, to draw the bars 48 upwardly from their rest positions shown in the Figures of the drawing. This causes the arms 72 of the pair of movable clamp elements designated by the reference letter B, to be moved clear of the upper cross member 78, after the lower cross member 80 of the smoke ejector frame has been positioned in the recesses 56. With the upper cross member 80 lined up with recesses 74, the handles of the upper pair B of movable clamp elements are released, so that the smoke ejector frame is now effectively clamped between the stationary clamp elements and the clamp elements of set or pair B.

When the smoke ejector is to be removed at the location where it is to be used, one need only pull upwardly upon the handles of the clamp elements of pair B, thus releasing the smoke ejector frame from the clamp elements of pair B, and permitting, as a consequence, the extraction of the lower portion of the smoke ejector frame from the recesses 56.

If a smaller smoke ejector is to be transported, one simply pulls upwardly upon the handles 76 of either the upper or lower pairs of movable clamp elements, to rotate the bars 90° from the positions thereof shown in FIG. 1. This disposes the clamp arms 72 of pair A in operative position, while automatically retracting the clamp arms of pair B to out-of-the-way positions where they will not interfere with attachment to the smoke ejector frame to the carrier.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A carrier of the back pack type intended especially for use by a firefighter for transporting a smoke ejector having a frame that includes upper and lower cross members, comprising:

(a) a back plate;

(b) quickly connectable strap means on the back plate for attaching the same to the body of a wearer in a position in which it will be supported against the wearer's back; and (c) means on the back plate spaced transversely thereof and releasably engageable with the upper and lower cross members of the smoke ejector, and supporting the smoke ejector upon the back plate in a position in which the ejector is substantially fixedly secured to and extends rearwardly from the back plate and said means.

2. A carrier for smoke ejectors as in claim 1, wherein said means includes first and second pairs of transversely spaced clamp elements, the elements of the first pair being fixedly attached to the back plate and the elements of the second pair being movably mounted on the back plate under spring bias tending to urge the same toward the clamp elements of the first pair.

3. A carrier for smoke ejectors as in claim 2, in which said means further includes a pair of parallel clamp support bars slidably mounted on the back plate, the clamp elements of said second pair being secured to the respective bars for movement therewith toward and away from the first pair of clamp elements.

4. A carrier for smoke ejectors as in claim 3, further including a spring interposed between each of said bars and the back plate to provide for said spring bias of the first pair of clamp elements toward the elements of the second pair.

5. A carrier for smoke ejectors as in claim 4, further including a third pair of clamp elements also mounted on the respective bars and spaced longitudinally of the bars from the second pair of clamp elements, whereby the second and third pairs of clamp elements are adapted to be selectively usable for accommodating smoke ejectors of different sizes.

6. A carrier of the back pack type especially intended for use by a firefighter in transporting a smoke ejector having a frame that includes upper and lower cross members, comprising:

(a) a back plate;

(b) means for strapping the same to the back of a wearer;

(c) a first pair of clamp elements fixedly secured to and projecting rearwardly from the back plate and adapted for engaging the lower cross members of said ejector;

(d) a pair of bars slidably mounted on the back plate for movement toward and away from said first pair of clamp elements;

(e) means resiliently, yieldably biasing the respective bars toward said clamp elements; and (f) a second pair of clamp elements secured to the respective bars for movement therewith and adapted to engage the upper cross members of the ejector.

7. A carrier of the back pack type as in claim 6 further including a third pair of clamp elements secured to the respective bars and spaced longitudinally thereof from the first pair of clamp elements whereby to provide for optional use of either the second or third pairs of clamp elements according to the size of the smoke ejector to be transported.

8. A carrier of the back pack type especially intended for use by a firefighter in transporting a smoke ejector having a frame that includes upper and lower cross members, comprising:

(a) a back plate;

(b) means for strapping the same to the back of a wearer;

(c) a first pair of clamp elements fixedly secured to and projecting rearwardly from the back plate and adapted for engaging the lower cross members of said ejector; and (d) second and third pairs of clamp elements mounted on the back plate under spring bias tending to urge the same toward the first pair of clamp elements, said second and third pairs being spaced different distances from the first pair for selective engagement of either the second or the third pair of elements with the upper cross member of the smoke ejector according to the distance between the cross members of the ejector to be transported.

9. A carrier of the back pack type as in claim 8 in which each of the second and third movable pairs of clamp elements is mounted for retraction to an inoperative position in which it lies against the back plate clear of the transported ejector when the other movable pair is operatively engaged with the upper cross member of the ejector.

10. A carrier of the back pack type especially intended for use by a firefighter in transporting a smoke ejector having a frame that includes upper and lower cross members, comprising:

(a) a back plate;

(b) means for strapping the same to the back of a wearer;

(c) a first pair of clamp elements fixedly secured to and projecting rearwardly from the back plate and adapted for engaging the lower cross members of said ejector;

(d) a pair of clamp element support bars mounted on the back plate for slidable and rotatable movement, under spring bias tending to slidably urge the same toward the first pair of clamp elements; and (e) movable second and third pairs of clamp elements secured to the respective bars for slidable and rotatable movement therewith and spaced longitudinally of the bars for selective use of said second and third pairs of elements in engaging the upper cross members of smoke ejectors of different sizes, the elements of said second pair being angularly spaced approximately 90° from the corresponding elements of the third pair whereby, on rotation of the bars through 90°, each movable pair of clamp elements will be disposed in a retracted out-of-the-way position against the back plate whenever the other movable pair is operatively positioned in engagement with the upper cross member of the transported smoke ejector.

11. A carrier of the back pack type as in claim 10 wherein the clamp elements of at least one of said movable pairs thereof are formed with means engaging the back plate at opposite extremes of the rotation of the bars through 90° of angular travel, to index the respective bars to positions in which one of the movable second and third pairs of clamp elements will be in an operative position and the other will be a retracted position when the carrier is awaiting use.

12. A carrier of the back pack type as in claim 11 wherein said indexing means comprises flat, perpendicularly related surfaces on said one movable pair of clamp elements each of which surfaces is adapted to lie in face-to-face contact with the back plate to prevent rotation of the bars, said bars being slidable by a user against said spring bias to positions in which said flat surfaces are clear of the back plate and thus permit rotatable indexing of the bar through 90° of angular travel thereof.

* * * * *